United States Patent [19]

Schmidt et al.

[11] 4,252,995

[45] Feb. 24, 1981

[54] RADIO BROADCASTING SYSTEM WITH TRANSMITTER IDENTIFICATION

[75] Inventors: Johan M. Schmidt; Johannes O. Voorman, both of Eindhoven, Netherlands

[73] Assignee: U.S. Philips Corporation, New York, N.Y.

[21] Appl. No.: 878,666

[22] Filed: Feb. 17, 1978

[30] Foreign Application Priority Data

Feb. 25, 1977 [NL] Netherlands ..... 7702019

[51] Int. Cl.[3] ..... H04H 5/00

[52] U.S. Cl. ..... 179/1 GD; 370/76; 375/52

[58] Field of Search ..... 179/15 BT, 15 BY, 1 GD, 179/1 GE; 325/36, 48, 64, 44, 320; 178/66 R, 67; 370/76; 375/52

[56] References Cited

U.S. PATENT DOCUMENTS

| | | | |
|---|---|---|---|
| 3,242,431 | 3/1966 | Crafts | 325/320 |
| 3,478,169 | 11/1969 | Saito | 179/15 BT |
| 3,902,019 | 8/1975 | Bruene | 179/15 BT |
| 4,048,619 | 9/1977 | Forman et al. | 179/15 BT |

FOREIGN PATENT DOCUMENTS

| | | | |
|---|---|---|---|
| 2424112 | 11/1975 | Fed. Rep. of Germany | 179/15 BT |

OTHER PUBLICATIONS

Sherwood Advertisement in "Stereo Review", Nov. 1977.

*Primary Examiner*—Douglas W. Olms
*Attorney, Agent, or Firm*—Thomas A. Briody; William J. Streeter; Edward W. Goodman

[57] ABSTRACT

FM radio broadcasting system with transmitter identification by means of a transmitted subcarrier whose frequency is a harmonic of subharmonic of the stereo pilot and which is binary phase modulated with transmitter identification signals. In the transmitter the subcarrier is locked to the stereo pilot and the unmodulated wave, which is required for detection of the transmitter identification signal, is derived in the receiver from the received stereo pilot.

7 Claims, 4 Drawing Figures

RADIO BROADCASTING SYSTEM WITH TRANSMITTER IDENTIFICATION

BACKGROUND OF THE INVENTION

The invention relates to a radio broadcasting system with transmitter identification wherein, at the transmitter side, a multiplex signal, which is frequency modulated on a main carrier, is transmitted, said multiplex signal comprising: an audio frequency information signal, in the case of stereo transmission a stereo information signal which is modulated on a suppressed stereo sub-carrier, a stereo pilot whose frequency is located between the frequency spectra of the audio frequency information signal and of the modulated stereo information signal and which serves, in a receiver, for demodulating the stereo information signal, as well as a binary transmitter identification signal modulated on a further sub-carrier, the frequency of this signal being located above the frequency spectrum of the modulated stereo information signal. In addition the invention relates to a transmitter for transmitting signals in accordance with such a system as well as to a receiver for receiving such signals.

When tuning the present FM radio receivers, the user often experiences great difficulties because the tuning scale only displays frequencies and/or channel numbers and not the names of the stations. In addition, one given program is often transmitted by several transmitters so that the user does not know if he has tuned to the strongest transmitter.

In order to provide the user with an easily recognisable identification of the FM transmitters and/or of the nature of the program transmitted by the transmitter, a radio broadcasting system with transmitter identification as described in the preamble has already been suggested to the CCIR (Comité Consultatif International des Radiocommunications). In this system, the transmitter identification signal is transmitted by means of a suitable carrier above the frequency spectrum of the stereo information signal. This carrier is frequency-modulated with the binary transmitter identification signal which, by means of a digital code, contains information on, for example, the name of the program, the location of the transmitter, the nature of the program and the channel number, so that, for example, the following information, consisting of 16 characters, is received:

Ned 1 Roerm KL 25

The receivers for such a system are provided with a decoder which decodes the binary transmitter identification signal from the signal received and uses it, for example, for wholly or partly optically displaying the information thus transmitted, so that the user can immediately see to which transmitter his receiver is tuned. Alternatively, it is possible to arrange the receiver in such a way that, at the reception of a preset transmitter identification code, a portion of the receiver, or of a tape recording or reproducing apparatus, is switched on or off. In particular, if the transmitter identification signal contains a special code which is transmitted for traffic reports, this code can be used to switch on the reproducing section of a car radio receiver or to stop a tape reproducing device which is in operation.

The above-mentioned prior art transmitter identification system has been tested in practice with the following values:

The sub-carrier frequency was 66 KHz and the frequency sweep 1 KHz, so that, due to the binary information, the frequency was switched between 65 KHz and 67 KHz. (Frequency shift keying).

The code used was the 6-bit ASCII-code having 16 characters per information.

The amplitude of this transmitter identification signal was chosen such that, of the totally available frequency sweep of 75 KHz for the FM modulation of the main carrier, 1 KHz, i.e. 1.33%, was occupied by the transmitter identification signal. The comparatively small amplitude (1 KHz) of this signal is opted for because experiments proved that a greater amplitude may cause interference noise in some types of FM-receiver.

It appeared, however, that the necessarily small amplitude of the transmitter identification signal and the comparatively high frequency thereof (66 KHz) resulted in a poor signal-to-noise ratio. In order to recover the code signal flawlessly, the receiver requires a high-grade filter having a good quality factor and a good temperature stability. In addition, it appeared that, in spite of the use of such a high-grade and expensive filter, decoding of the transmitter identification signal no longer occurs flawlessly with aerial voltages below 10 $\mu$V (at 60 ohm) whereas the average FM-receivers still furnish an acceptable mono-reception at such aerial voltages.

SUMMARY OF THE INVENTION

It is an object of the invention to provide a radio broadcasting system with transmitter identification which enables a substantially flawless decoding of the transmitter identification signal even at so low received aerial voltages where an acceptable mono-reception is not or hardly possible, which furthermore avoids distortion of the radio broadcast in existing receivers whereas, furthermore, high-grade and, consequently, expensive filtering means in the receiver can be dispensed with. The radio broadcasting system according to the invention is, therefore, characterized in that said further sub-carrier is a harmonic of a subharmonic of the stereo pilot, not coinciding with a harmonic of the stereo pilot, and being derived at the transmitter side from the same frequency source as the stereo pilot, and that the transmitter identification signal is binary phase modulated on this sub-carrier.

The expression "binary phase modulation" stands for 180-degree-phase-reversal of the subcarrier under the control of the binary code-signal. With this type of modulation the original subcarrier may become completely suppressed.

Using phase modulation (phase shift keying) instead of frequency modulation (frequency shift keying) for the modulation of the sub-carrier with the binary transmitter identification signal results in an improvement in the signal-to-noise ratio. In contrast to the demodulation of the frequency-modulated sub-carrier the demodulation of the phase-modulated subcarrier requires, however, an unmodulated ("clean") subcarrier. Generating this subcarrier at the receiving side could be effected by squaring the incoming binary phase-modulated signal which results in a carrier having double the frequency, by thereafter filtering this carrier with double frequency, and subsequently having the carrier of the original frequency recovered from the carrier of double this frequency by means of a frequency divide-by-two divider.

With this method, in the case of poor signal-to-noise ratios, the carrier of double the frequency must be obtained from a signal having a high degree of noise. If, for example, a so-called Phase Locked Loop is used for this purpose then this can indeed be effected by using a low-pass filter having a low cut-off frequency in this loop in such a way that the phase of the voltage-controlled oscillator of the phase loop is not modulated too much by noise, on the other hand such a low-pass filter having a low cut-off frequency reduces the pulling-in range of the phase locked loop to such an extent that a voltage-controlled oscillator having a very stable free-running frequency is now required. In practice this can only be obtained with a crystal-controlled oscillator.

With the present invention, wherein binary phase modulation of the subcarrier for the transmitter identification signal is used in combination with a frequency relation between the stereo pilot and said subcarrier, which relation is fixed at the transmitter side, a system is obtained which can be realized without highgrade means and which is comparatively insensitive to poor signal-to-noise conditions.

The subcarrier for the transmitter identification signal can now be recovered with much simpler means because the stereo pilot is modulated with a much greater frequency sweep (10% of the total frequency sweep of 75 KHz) on the main carrier than the transmitter identification signal itself (1.33% of the total frequency sweep of 75 KHz) whereas, in addition, the stereo pilot has a much better signal-to-noise ratio, owing to its lower frequency, than the transmitter identification subcarrier which has a much higher frequency.

In a receiver for use in a system according to the invention, phase errors may occur which are produced by different delay times for the transmitter identification signal and for the stereo pilot in the tuner or in the IF section of the receiver. Also phase-multiplicities may occur because the subcarrier frequency ($\omega_k$) of the transmitter identification signal is equal to a "fractional" harmonic of the stereo pilot ($\omega$); this expression means that $\omega_k=(n/m)\omega$, were m and n are integers but n is not divisable by m. The frequency divisions required thereby in the transmitter and in the receiver may produce these phase multiplicities.

In accordance with a further aspect of the invention, a phase corrector is used in a receiver according to the invention which can adjust the phase of the unmodulated wave, required for detecting the modulated transmitter identification signal, relative to the modulated transmitter identification signal itself. This phase corrector is controlled from a phase detector which compares the phase of the modulated transmitter identification signal to the phase of the unmodulated wave obtained from the stereo pilot and the phase-corrector corrects any phase errors, depending on the result of this comparison. As the carrier itself is missing in the binary phase-modulated identification signal this cannot be done, however, without further measures.

A first method to solve this difficulty is the use of frequency doubling of the modulated transmitter identification signal which provides an unmodulated carrier of twice the subcarrier frequency. This carrier of twice the subcarrier frequency is applied to one input of the phase detector, a wave of likewise twice the subcarrier frequency, which is obtained by means of frequency multiplication and/or division of the stereo pilot, being applied to the other input.

A second method consists in the use of a phase inverter in one of the input leads or in the output of the phase detector, which phase inverter is controlled by the demodulated output signal of the synchronous detector.

It appears that in both cases a phase-duplicity between the modulated subcarrier and the unmodulated wave is left, however this phase duplicity does not really matter if a code is used which is insensitive for such duplicity, for instance, a so-called differential code may be applied for the code which is modulated on the subcarrier. This is a code with which the two binary states are not transmitted by two phase conditions of the subcarrier but by the occurrence, or non-occurrence respectively, of a phase transition from the one phase to the other or vice versa.

The frequency of the subcarrier is preferably chosen between the third and the fifth harmonic of the stereo pilot. Choosing it below the $3^{rd}$ harmonic brings the subcarrier too closely to the spectrum of the stereo information signal and choosing it above the $5^{th}$ harmonic increases the chance for disturbances due to adjacent transmitters.

Interference may occur in existing stereo receivers between the subcarrier for the transmitter identification and the second harmonic of the 38 KHz signal required for stereo detection, which corresponds to the $4^{th}$ harmonic of the pilot. For this reason the subcarrier for the transmitter identification should not be located too near this fourth harmonic.

Due to the non-linear phase characteristic of the intermediate frequency section of the receiver, an interference product, having a frequency equal to the difference frequency between the subcarrier and the stereo pilot, occurs in the multiplex signal. This interference product may, after detection with the 38 KHz wave, cause audible noise if the subcarrier is located too near the $3^{rd}$ harmonic of the stereo pilot.

The above-mentioned non-linear phase characteristic furthermore causes noise in the environment of the whole harmonics of the stereo pilot. For the above reasons the subcarrier is located to coincide with a harmonic of the stereo pilot and preference should be given to a position of the subcarrier approximately halfway between two harmonics.

DESCRIPTION OF THE DRAWINGS

The invention will be further explained with reference to the Figures in the accompanying drawings. Herein.

DESCRIPTION OF THE PREFERRED EMBODIMENTS

Figure 1:
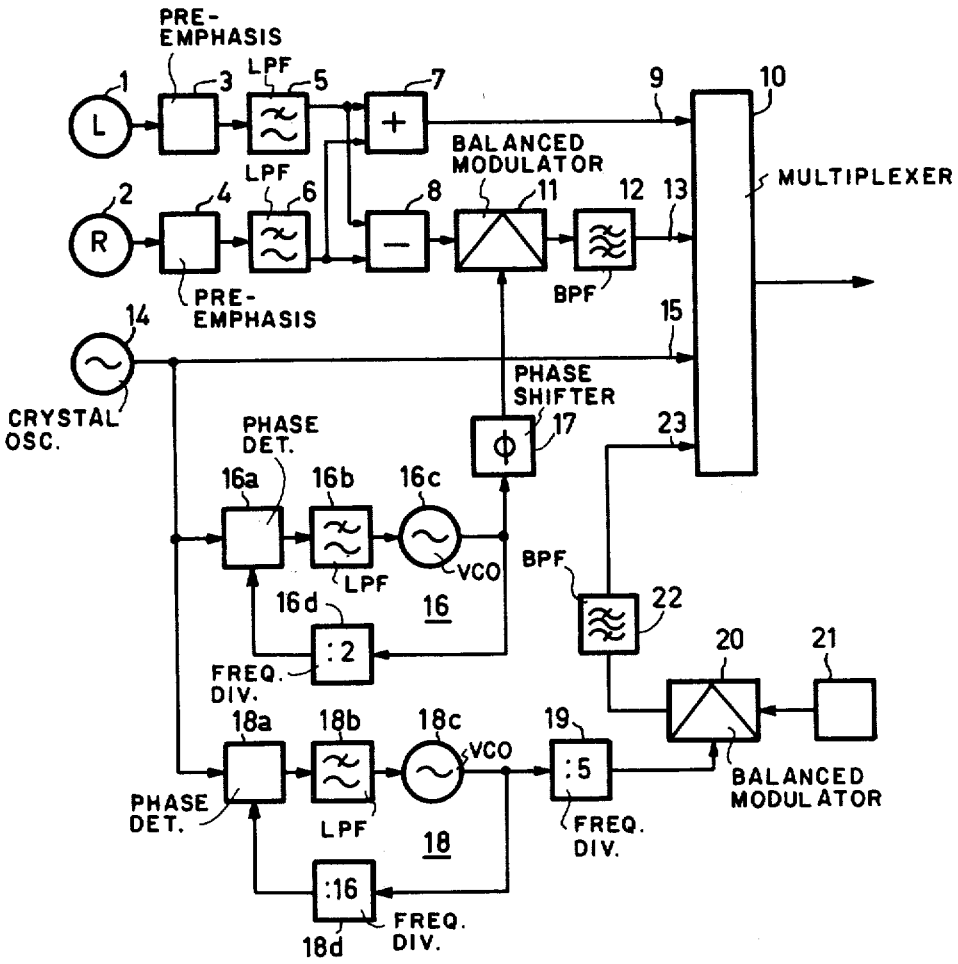
FIG. 1 is a block diagram of an embodiment of a transmitter for the system according to the invention.

The transmitter of FIG. 1 comprises a source of left-hand audio signals 1 and a source of right-hand audio signals 2. Each of the left-hand and right-hand audio signals are applied, via pre-emphasis networks 3 and 4, respectively, and via low-pass filters 5 and 6, respectively, each having a cut-off frequency of 15 KHz, to an adder circuit 7 and to a subtracter circuit 8. Thereafter, the sum signal L+R obtained from the adder circuit is applied to an input 9 of a multiplexer 10. The difference signal L−R of the subtractor circuit 8 is modulated in a balanced modulator 11 on a stereo subcarrier of, for example, 38 KHz and the modulated information signal thus obtained, which consists of two side-bands with the suppressed stereo subcarrier, is applied via a bandpass filter 12 to a second input 13 of the multiplexer 10.

In addition the transmitter of FIG. 1 comprises a stable oscillator 14, for example a crystal oscillator, which supplies a wave of, in general, 19 KHz which is used as a stereo pilot. This stereo pilot is applied to a third input 15 of the multiplexer 10.

The stereo-pilot of the oscillator 14 is also applied to a so-called phase-locked loop 16 which includes a phase detector **16*a*, a low-pass filter 16*b*, a voltage-controlled oscillator 16*c* and a frequency-divide-by-two divider 16*d*. The phase-locked loop 16 is used for producing the stereo subcarrier whose frequency (38 KHz) is equal to twice the frequency of the stereo pilot and which is phase-locked to the stereo pilot. The operation of such a phase-locked loop is known; the 38 KHz output signal of the oscillator 16*c* is converted in the divide-by-two divider 16*d* into a 19 KHz signal which is compared in the phase detector 16*a* with the 19 KHz pilot of the oscillator 14. The output voltage of the phase detector 16*a* is filtered in low-pass filter 16*b* and applied as control voltage to the oscillator 16*c***.

Via a phase shifter 17, the 38 KHz output signal of the phase-locked loop 16 is applied as the stereo subcarrier to the modulator 11 for modulating the L−R signal. The phase shifter 17 is used to give the stereo sub-carrier the internationally prescribed phase relative to the 19 KHz stereo pilot.

A second phase-locked loop 18, which is connected to the 19 KHz oscillator, comprises a phase detector **18*a*, a low-pass filter 18*b*, a voltage-controlled oscillator 18*c* and a 16-scaler 18*d*. The phase-locked loop 18 operates in a similar manner as the phase-locked loop 16 and supplies an output signal, which is locked to the stereo pilot, of 304 KHz, i.e. 16 times the pilot frequency. Thereafter, the 304 KHz signal of the phase-locked loop 18 is reduced in a 5-scaler 19 to 60.8 KHz and the latter signal is applied, as the further subcarrier of the transmitter identification signal, to the carrier input of a balanced modulator 20. The modulation input of the modulator 20 is connected to a diagrammatically shown arrangement 21** for generating a suitable binary code which includes the transmitter identification information, for example, a code as described in the preamble.

The modulator 20, may, for example, be a ring modulator or a dual long-tail circuit or any other known modulator which, under the influence of the bits derived from the arrangement 21, shifts the phase of the 60.8 KHz signal from the 5-scaler 19 over 180°. The 60.8 KHz signal, phase-modulated in this way, is applied, via a band pass filter 22 having a bandwidth of approximately 4 KHz, to a fourth input 23 of the multiplexer 10. The multiplexer 10 combines the signals at the inputs 9, 13, 15 and 23 and supplies them combined to a FM-transmitter, which is not shown in the drawing.

Figure 2:
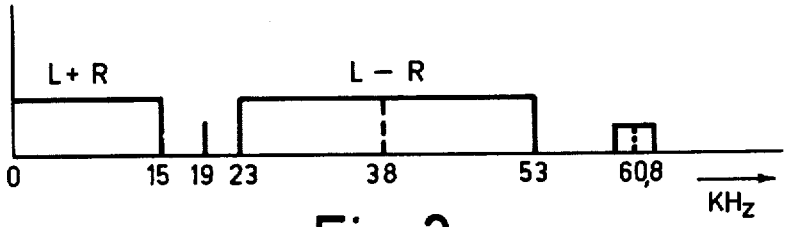
FIG. 2 shows the frequency spectrum of the multiplex signal, generated in the system according to the invention, at the transmitter side and obtained at the receiver side after FM-demodulation.

For further explanation FIG. 2 shows the frequency spectrum of the signal obtained at the output of the multiplexer. Between 0 and 15 KHz there is the sum signal L+R supplied via the input 9, at 19 KHz there is the stereo pilot supplied via the input 15, between 23 and 53 KHz there is the L−R signal which is modulated at 38 KHz and which is supplied via the input 13 and at 60.8 KHz there is the approximately 4 KHz wide transmitter identification signal which is supplied via the input 23. It should be noted that the relative amplitude ratios generally deviate more from one another than is indicated for the sake of clearness. In general, the stereo pilot is approximately 9× smaller than the L+R and L−R components and the amplitude of the transmitter identification signal is preferably chosen to be approximately 10× smaller than that of the stereo pilot.

Figure 3:
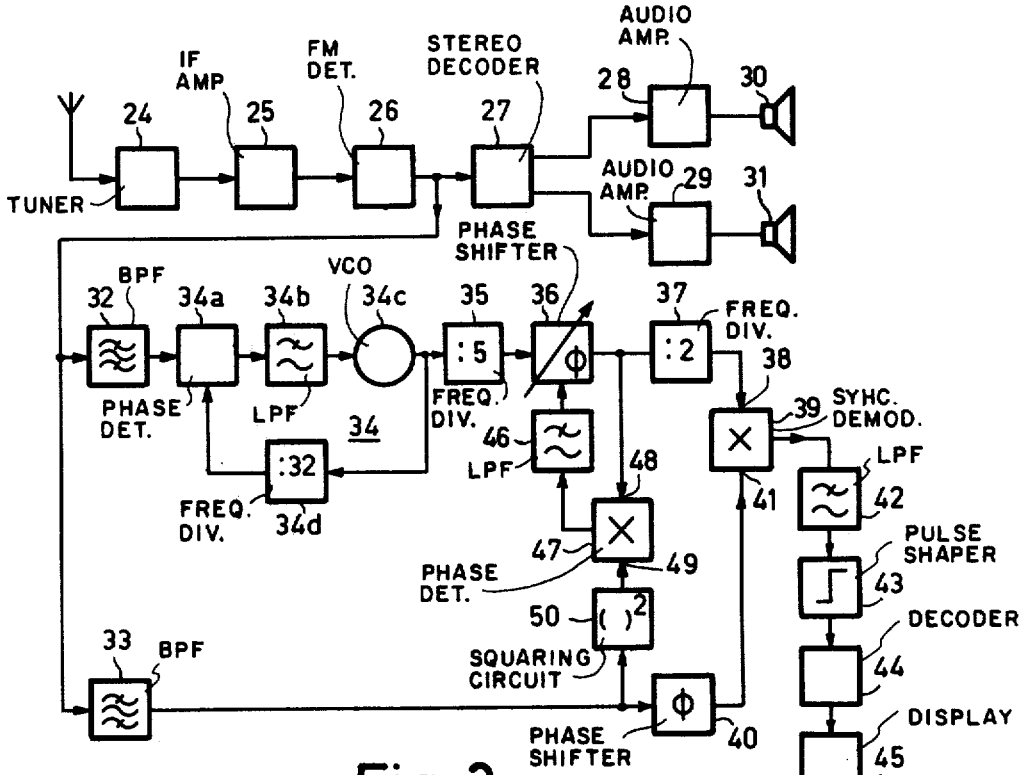
FIG. 3 is a block diagram of a first embodiment of a receiver according to the invention and FIG. 4 is a block diagram of a second embodiment of a receiver according to the invention.

The receiver of FIG. 3 comprises a tuner 24, an intermediate frequency amplifier 25 and an FM-detector 26. The multiplex signal, which is composed of the components shown in FIG. 2, is available at the output of this FM-detector. For a stereo receiver, this multiplex signal is applied to a stereo decoder 27 which supplies the left-hand and right-hand audio signals which are supplied via audio amplifiers 28 and 29 to a left-hand and a right-hand loudspeaker 30 and 31.

For demodulating the transmitter identification signal, the multiplex signal is applied to a 19 KHz bandpass filter 32 for the stereo pilot and a 60.8 KHz bandpass filter 33 for the transmitter identification signal. The stereo pilot, which is filtered out by means of the filter 32, is additionally filtered and its frequency multiplied by a phase-locked loop 34 which includes a phase detector **34*a*, a low-pass filter 34*b*, a voltage-controlled oscillator 34*c* and a 1:32 frequency divider 34*d*. Its operation is similar to that of the phase-locked loops 16 and 18 of FIG. 1**.

The output wave of the phase-locked loop 34, which has a frequency of $32\times 19=608$ KHz is thereafter reduced to 121.6 KHz in a five-scaler 35, then passed through a controllable phase shifter 36, whose function will be explained hereinafter, thereafter divided in a divide-by-two divider 37 to 60.8 KHz and, finally, applied to a first input 38 of a synchronous demodulator 39.

The 60.8 KHz phase-modulated transmitter identification signal originating from the bandpass filter 33 is applied via a 45° phase shifter 40 to a second input 41 of the synchronous demodulator 39. The synchronous detection of the 60.8 KHz phase-modulated transmitter identification signal at the input 41 by means of the unmodulated 60.8 KHz wave at the input 38 furnishes, at the output of the synchronous demodulator 39, the demodulated binary transmitter identification signal. The binary code signal is then passed through a low-pass filter 42, after which it is formed into square pulses in a pulse shaper 43 and applied to a decoder 44. This decoder converts the binary transmitter identification signal into signals suitable for driving a "display" 45.

For a proper synchronous detection in the demodulator 39, the unmodulated wave at the input 38 must have the proper phase relation relative to the modulated signal applied to the input 41. In general, this proper phase relation is not guaranteed due to the following causes:

1. Due to the insufficient linear phase characteristic of the intermediate frequency amplifier 25, the 19 KHz stereo pilot and the 60.8 KHz transmitter identification signal may be subjected to mutually different delay times.

2. The input filters 32 and 33 may effect unwanted phase shifts.

3. Due to the frequency division by the divider 19 in the transmitter, the phase of the transmitted 60.8 KHz transmitter identification signal is no longer unambiguously determined relative to the transmitted stereo pilot. A similar phase ambiguity is caused by the frequency divider 35 in the receiver.

In order to obviate all these phase problems, the circuit of FIG. 3 comprises the adjustable phase shifter 36 mentioned above. This shifter 36 is controlled, via a low pass filter 46, by a phase detector 47. The phase detector 47 has two inputs 48 and 49, the input 48 of which is connected to the output of the phase shifter 36, the input 49 being connected to the output of a device 50 which produces an unmodulated wave of double the frequency (namely 121.6 KHz) from the phase-modulated signal of the filter 33. To this end, the device 50 has a nonlinear characteristic with even-power-terms, for example, a squaring circuit or a full-wave rectifier.

Because the phase-locked loop 34 multiplies the stereo pilot by a factor of two more than necessary for the synchronous detection, the frequency of the wave which is applied to the input 48 of the phase detector 47 is equal to double the carrier frequency. Therefore, measuring the phase by means of the phase detector 47 is effected at double the carrier frequency and the result of the measurement is used to compensate the above-mentioned unwanted phase shifts in the controllable phase shifter 36. It should be noted that the frequencies of the two signals which are connected to the phase detector 47 are always equal to one another so that no pulling-in problems can arise. The phase errors which are corrected therewith vary only slowly and the low-pass filter 46 can, consequently, have a very low cut-off frequency (for example 10 Hz). Due to this low cut-off frequency, rapid phase variations, which might be produced due to the noise in the transmission path 33-40-41 of the transmitter identification signal, can be effectively suppressed. By means of the described measures, it is possible to obtain for the synchronous detector 39 an unmodulated wave of the proper frequency and the proper phase and which is noise-free to a very high degree. Since, due to the phase control by means of 36, 46, 47, the phase is compensated at double the carrier frequency, the phase relation at the inputs of the synchronous detector 39 is still not unambiguous (180° phase duplicity). When using a (differential) code which is insensitive thereto, a proper transmission of the code signal can, however be guaranteed.

The automatic phase control, by means of the phase controller 36, always operates so that the two input signals of the phase detector 47 are shifted 90° in phase relative to one another. Moreover, it is desirable that the mutual phase relation between the input signals of the synchronous detector 39 is 0° or 180°. If the two-scaler 37 is so constructed that the zero-crossings of its output-wave coincide with the zero-crossings of its input-wave, and if the frequency doubler 50 is engineered as a squaring circuit in which the tops of the input wave coincide with tops of the output wave, then this preferred phase-relation is achieved without further measures. In other cases, an additional phase-correction could be provided in one of the input leads of the detectors 47 and 39, namely a 90° correction for the double carrier frequency or a 45° correction for the carrier frequency itself. The 45° phase shifter 40 is used in this embodiment. It should be noted that several variants of the circuit of FIG. 3 are possible. It is, for example, possible to replace the divide-by-two divider 37 by a frequency doubler in the input lead 48 of phase detector 47. The frequency multiplication factor of the phase-locked loop 34 should then be a factor of 2 smaller. Alternatively it is, for example, possible to include the phase controller 36 in the output lead of the filter 33.

If instead of 16/5 times the stereo pilot, 7/2 times this pilot should, for example, be chosen for the carrier frequency of the transmitter identification signal, the dividend of the divider **34*d* should equal 14 and that of the divider 35 should be equal to 2. It is then, of course, simpler to chose the dividend of 34*d* to be equal to 7 so that the divider 35** can be dispensed with.

Figure 4:
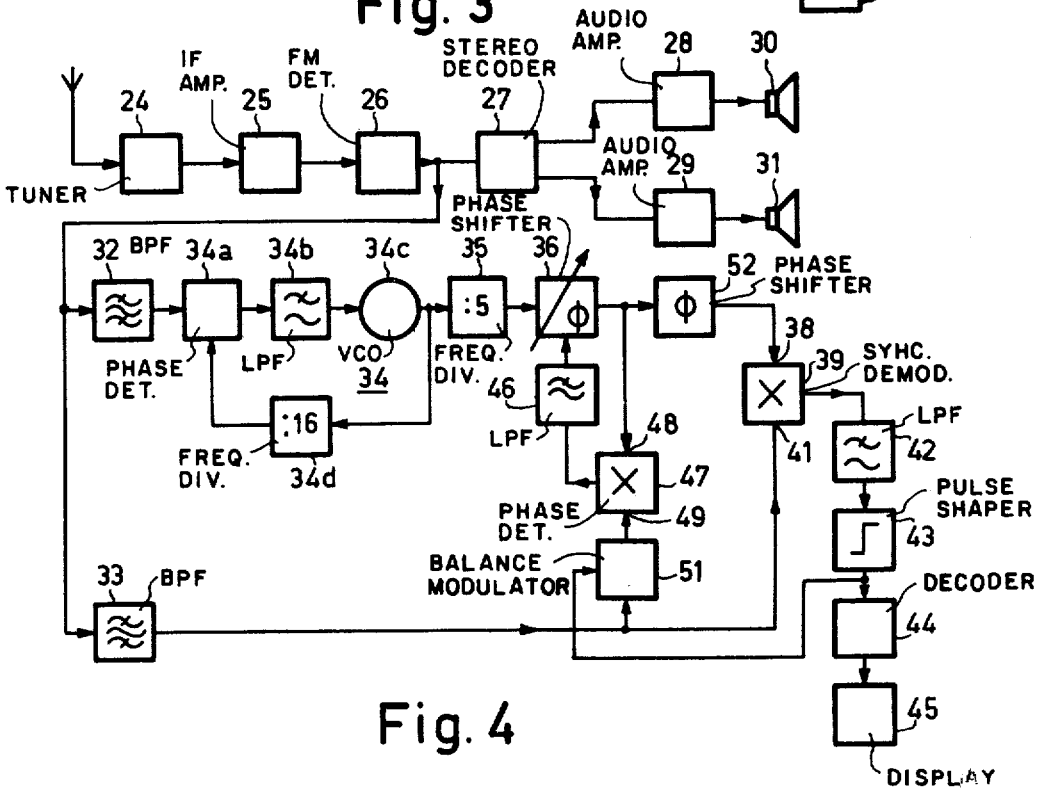

In the embodiment of FIG. 4, the units which correspond to the functional units of FIG. 3 have been given the same reference numerals.

Whereas in the embodiment of FIG. 3 the phase comparison for the control of the phase corrector 36 is effected at double the carrier frequency, it is effected, for the embodiment of FIG. 4, at the carrier frequency itself. To this end, the frequency doubling circuit 50 and the frequency divide-by-two divider 37 are omitted and the dividend of the frequency divider **34*d*** is reduced to 16.

Via the phase shifter 36, the divider 35 now supplies an unmodulated carrier of the carrier frequency (60.8 KHz) to the input 48 of the phase detector 47.

A phase inverter 51 (balanced modulator) is included in the lead to the input 49 of the phase detector 47. The phase inverter 51 is controlled by the output signal of the synchronous detector 39 or, alternatively, by the output signal of the pulse shaper 43. Each time the phase of the transmitter identification signal is changed 180° due to the code signal, a transient appears in the output signal of the pulse shaper 43 which effects a phase reversal by the phase inverter 51 so that, at the input 49, the original phase reversal is cancelled. Therefore, the input 49 of phase detector 47 is supplied with the 60.8 KHz transmitter identification carrier from which the original phase modulation is removed. In the phase detector 47 the phase of this unmodulated carrier is compared relative to the wave at input 48 and any phase errors are compensated again by the phase shifter 36 via low pass filter 46.

Instead of being included in the lead to the input 49, the phase inverter 51 may be included in the supply lead to the input 48 of the phase detector 47. The 60.8 KHz carrier supplied via the phase shifter 36 is then phase-modulated by the binary code signal in the same manner as the transmitter identification signal itself has been modulated. Then the phase detector 47 supplies again an output voltage which can be used for the phase correction.

A third possibility is to include the phase inverter 51 in the output lead of the phase detector 47 either before or after the filter 46. The phase detector 47 itself then supplies the binary code signal but as the phase inverter changes state at each transient of this signal, the output signal of the phase inverter 51 becomes a D.C. voltage which can be used for the phase correction.

A 90° phase shifter 52 in the input lead 38 of the synchronous detector 39 has a similar function as the 45° phase shifter 40 of FIG. 3. Alternatively, the phase shifter 52 may be included in the input lead 41 of the synchronous detector 39 or in one of the input leads of the phase detector 47.

A further analysis of the circuit of FIG. 4 shows that the entire phase correction system has two stable control conditions wherein the phase difference of the signal at the input 49 relative to the signal at the input 48 of the phase detector 47 can be +90° or −90°. The detection of the binary code signal by means of the synchronous detector 39 has consequently the same ambiguity as in the receiver of FIG. 3.

The circuits shown in FIGS. 3 and 4 do not require resonant circuits which satisfy high selectivity requirements because a large part of the required selectivity can be realized at low frequency, that is to say by low-pass filters (34*b*, 46, 42). Consequently, the bandpass filters 32 and 33 need only have moderate quality factors (approximately 20). Recent tests have shown that the stereo pilot filter 32 may even be dispensed with completely.

In some cases it is also possible to obtain from the stereo decoder 27 a stereo pilot which has already been filtered. The input of the phase-locked loop 34 is then connected to a suitable point in the stereo decoder 27.

The functional units shown in the FIGS. 1, 3 and 4 are all known per se and, consequently, require no further explanation. the controllable phase shifter 36 should preferably be capable of being varied over nearly 360° and this unit can be implemented by the cascade arrangement of two monostable flip-flops, the first of which has a controllable time constant and the second a fixed time constant equal to half the cycle of the signal to be processed. The leading edge of the input signal starts the first monostable flip-flop and the trailing edge of the signal of the first flip-flop starts the second monostable flip-flop.

What is claimed is:

1. A transmitter for a radio broadcasting system with transmitter identification, said transmitter comprising means for providing an audio frequency information signal, a modulator for modulating a stereo information signal on a suppressed stereo subcarrier, an oscillator for generating a stereo pilot whose frequency is located between the frequency spectra of the audio frequency information signal and of the modulated stereo information signal, a source of binary transmitter identification signals, a circuit for deriving from the stereo pilot a further subcarrier whose frequency is a harmonic of a subharmonic of the stereo pilot which is not coinciding with a harmonic of the stereo pilot, a further modulator for binary phase modulating said further subcarrier with the transmitter identification signal, and a combination circuit for combining the modulated transmitter identification signal with the audio information signal, the stereo information signal and the stereo pilot.

2. A transmitter for a radio broadcasting system as claimed in claim 1, wherein the frequency of said further subcarrier is located in the middle between two harmonics of the stereo pilot.

3. A receiver for the reception of radio broadcasting signals with transmitter identification wherein a main carrier is frequency modulated by a multiplex signal comprising an audio frequency information signal, a stereo information signal modulated on a suppressed stereo subcarrier, a stereo pilot, and a binary transmitter identification signal which is binary phase modulated on a further subcarrier which is a harmonic of a subharmonic of the stereo pilot not coinciding with a harmonic of the stereo pilot, said receiver comprising a frequency discriminator for demodulating the received main carrier, a synchronous demodulator having first and second inputs and an output, a first transmission path coupled to the output of the discriminator for applying the binary phase modulator transmitter identification signal to the first input of the synchronous demodulator, a second transmission path coupled to the output of the frequency discriminator for applying an unmodulated wave synchronized by the stereo pilot to the second input of the synchronous demodulator, and and output circuit coupled to the output of the synchronous demodulator for the demodulated transmitter identification signal.

4. A receiver as claimed in claim 3, which further comprises means for generating a control signal in dependance upon the relative phase of the carrier wave of the binary phase modulated signal applied to the first input of the synchronous demodulator and the unmodulated wave applied to the second input of the synchronous demodulator, said means having an input connected to a connection point of the first transmission path, an input connected to a connection point of the second transmission path, and an output; and an electronically controllable phase-shifter connected in one of said transmission paths and having a control input coupled to the output of said means for controlling said relative phase.

5. A receiver as claimed in claim 4, wherein said means for generating a control signal comprises a phase detector having first and second inputs and an output, and a frequency doubler connected between the connection point of the first transmission path and the first input of the phase-detector, the connection point of the second transmission path being coupled to the second input of the phase detector, the output of the phase detector being coupled to the control input of the electronically controllable phase-shifter for controlling said relative phase.

6. A receiver as claimed in claim 4, wherein said means for generating a control signal comprises a phase detector having first and second inputs and an output, a phase-inverter, first coupling means for coupling the connection point of the first transmission path to the first input of the phase detector, a second coupling means for coupling the connection point of the second transmission path to the second input of the phase detector, a third coupling means for coupling he output of said phase detector to the control input of the controllable phase-shifter, said phase inverter being included in one of said first, and a second and third coupling means and being controlled by the output signal of the synchronous detector.

7. A receiver as claimed in claim 4, wherein said electronically controllable phase-shifter is connected in said second transmission path before said connection point of the second transmission path.

* * * * *